US006840475B1

(12) United States Patent
Mucke et al.

(10) Patent No.: US 6,840,475 B1
(45) Date of Patent: Jan. 11, 2005

(54) METHOD AND DEVICE FOR THE ROLLING OR WINDING OF STRIP

(75) Inventors: Gert Mucke, Hilden (DE); Eberhard Neuschutz, Ratingen (DE); Frank Gorgels, Aachen (DE)

(73) Assignee: Betriebsforschungsinstitut VDEh-Institut fur angewandte Forschung GmbH, Dusseldorf (DE)

( * ) Notice: Subject to any disclaimer, the term of this patent is extended or adjusted under 35 U.S.C. 154(b) by 0 days.

(21) Appl. No.: 09/666,867

(22) Filed: Sep. 20, 2000

(30) Foreign Application Priority Data

Sep. 21, 1999 (DE) ..... 199 45 202

(51) Int. Cl.[7] ..... B65H 23/26; B21B 38/06

(52) U.S. Cl. ..... 242/419.6; 242/534; 242/548; 72/11.4; 72/11.7; 72/205

(58) Field of Search ..... 242/419.6, 419.7, 242/419.8, 534, 417.3, 548; 226/113, 114, 118.2, 118.3, 44, 45; 72/11.7, 12.7, 12.8, 16.8, 18.7, 8.7, 12.3, 205, 11.4, 11.8, 11.9

(56) References Cited

U.S. PATENT DOCUMENTS 1,958,692 A * 5/1934 Besal et al. ..... 242/419.7
2,433,014 A * 12/1947 Rendel ..... 242/419.6
3,227,347 A * 1/1966 Perrine ..... 242/417.3
3,268,142 A * 8/1966 Macomson ..... 242/419.6
3,330,457 A * 7/1967 Foster et al. ..... 226/44
4,339,934 A * 7/1982 Mitchell ..... 72/12.7
4,463,586 A * 8/1984 Griffin ..... 72/11.7
4,478,062 A * 10/1984 Huzyak ..... 72/11.7
5,308,010 A * 5/1994 Hakiel ..... 242/534
5,778,717 A * 7/1998 Berger et al. ..... 72/205
5,964,390 A * 10/1999 Borresen et al. ..... 242/417.3

FOREIGN PATENT DOCUMENTS

DE 195 24 729 A1 1/1997

* cited by examiner

*Primary Examiner*—John Jillions
(74) *Attorney, Agent, or Firm*—Merchant & Gould P.C.

(57) ABSTRACT

The invention relates to a method and a device for the rolling or winding of strip having an equal thickness over the strip width, in which the tension in a strip length portion limited by rolls, winders, or control, guide or deflecting rollers is measured by means of a measuring roller. In order, in this case, to obtain more accurate measurement values and keep disturbing stresses away from the measuring point, between the measuring roller and an assembly (roll, winder, or control, guide or deflecting roller) causing disturbing stresses in the strip, a partitioning device for absorbing the disturbing stresses is arranged.

4 Claims, 4 Drawing Sheets

METHOD AND DEVICE FOR THE ROLLING OR WINDING OF STRIP

The invention relates to a method for the rolling or winding of strip having an unequal thickness over the strip width, in which the tension over the strip width in a strip length portion limited by rolls, winders, or control, guide or deflecting rollers is measured by means of a measuring roller, and claims the priority of German patent application 199 45 202.4, to the content of which reference is made.

The hot rolling of metallic strip, particularly in rolling mill trains for wide strip, gives rise to an uneven thickness profile over the strip width and strip length. As a rule, such a wide strip has a smaller thickness at its side edges than in its center. Wide strip of this kind is often subdivided in the longitudinal direction into narrower strips. These longitudinally divided strips (split strips) then have, at least partially, a wedge-shaped cross section, in which one edge region is thicker than the other, opposite edge region. Such a wedge-shaped cross section presents difficulties during the further processing of the split strip. This applies whenever the split strip is rolled, wound on winders or guided via rollers, such as, for example, deflecting rollers.

If, for example, such a strip is to be reduced in thickness by rolling, it runs out of true laterally in the roll nip formed by the processing rolls and on the winder, because, when the strip of wedge-shaped cross section is being wound, a varying winding diameter over the strip width is established and then consequently brings about an asymmetric distribution of longitudinal tension over the strip width. Equalization of the tensions in the strip, stabilization of the rolling process and a reduction in the out-of-true running of the strip are achieved by means of stabilizing rollers which are arranged upstream and downstream of the roll nip. DE-A-195 24 729 describes such a method and a corresponding device. According to this, guide rollers of the device can be inclined in an essentially vertical plane, in order thereby to tilt the strip by a limited amount out of its horizontal position and thus equalize the strip tensions and counteract its running out of true laterally in the roll nip. Said publication also describes a pivoting of the guide rollers in the horizontal plane for the same purpose. In this case, the stabilizing rollers are to be adjusted as a function of the distribution of the tensile stresses over the width of the strip. The tensile stress distribution is measured for this purpose. Consequently, in the known device, the stabilizing rollers are mounted on bearing pedestals, on which force-measuring sensors are arranged for determining the tensile force asymmetry present in the strip.

However, the known method cannot prevent the measurement of the tensile stress distribution in the strip from continuing to be subject to serious errors. What tensile stress distribution during rolling actually occurs depends on the particular process situation. To be precise, the tensile stress at the measuring point is composed of various stresses. These are, in the first place, tensile stresses which occur as a result of the varying length distribution of the strip over its width. These are the stresses actually to be measured. However, disturbing stresses also arise, which occur only because the strip running out of true laterally on account of its wedge-shaped cross section no longer runs onto a following assembly (roll, winder, or control, guide or deflecting roller) perpendicularly to the axis of rotation.

If such a strip is wound onto a winder in this way, such as, for example, downstream of the roll nip during rolling, the run-on points of the strip on the winder are displaced, and an asymmetric strip geometry is obtained. As long as this situation persists, in the length portion of the strip between the roll nip and winder a stress state is established, in which the highest stress occurs at the corners located diagonally opposite one another, whilst the stresses at the other points are markedly lower. This gives rise to diagonal folds in the strip, and this state is therefore also designated the "towel effect". In the known method and in the measurement, carried out in this, of the tensile stress distribution over the strip width, this effect leads to a falsification of the measurement values, because those tensile stresses occurring as a result of the varying length of the strip over its width have superposed on them the tensile stresses arising from the towel effect. Consequently, these measurement values cannot be used for accurate measurement and therefore also not for the accurate control and regulation of the strip planeness, since it is not possible to distinguish between the actual tensile stresses corresponding to the length distribution and the disturbing stresses.

The object on which the invention is based is to provide a method and/or a device, whereby it is possible to obtain more accurate measurement values.

This problem is solved, according to the invention, in that disturbing stresses in the strip, caused by distortions when the strip runs out of true, are kept away from the measuring roller by means of a partitioning device. Such a partitioning device ensures that only those tensile stresses in the strip arise in the region of the measuring roller which occur as a result of the varying length of the strip over its width. The abovementioned disturbing stresses cannot be avoided in the case of a strip of uneven thickness, but are kept away by means of the partitioning device from that point on the strip where the measuring roller measures the tensile stress distribution in the strip.

The subject of the invention is, moreover, a device for the rolling or winding of strip having an unequal thickness over the strip width, which possesses a measuring roller for measuring the stresses in a strip length portion limited by rolls, winders, or control, guide or deflecting rollers. This device is defined, according to the invention, in that, between the measuring roller and an assembly (roll, winder, or control, guide or deflecting roller) causing disturbing stresses in the strip, a partitioning device for absorbing the disturbing stresses is arranged. In this case, the partitioning device is arranged between the measuring roller and that point from which the disturbing stresses emanate. Depending on the type of device, it may be necessary to use a second partitioning device if disturbing stresses may take effect relative to the measuring roller from a second side. At all events, when the partitioning systems are used, the measuring roller actually determines only those stresses over the strip width which correspond to the length distribution of the strip and from which correct values for controlling, regulating and measuring can be derived.

In a preferred embodiment of the invention, the partitioning device possesses a roller, preferably a plurality of rollers which maintain close contact with the strip via a surface with a good grip and over a sufficiently large looping angle. This close contact with the strip brings about an aligning effect in the strip, since the disturbing stresses are transmitted and dissipated from the strip to the rollers and their mounting.

It is advantageous if the rollers of the partitioning device are mounted adjustably, but so as to be at a fixed location during operation. The adjustability of the rollers makes it possible to set these perfectly, in particular to ensure as large a looping angle as possible and consequently a sufficient partitioning effect. A firm fixed mounting of the rollers during operation ensures that the disturbing stresses are dissipated reliably.

The invention is explained in more detail below by means of exemplary embodiments illustrated in the drawing, in which.

Figure 1:
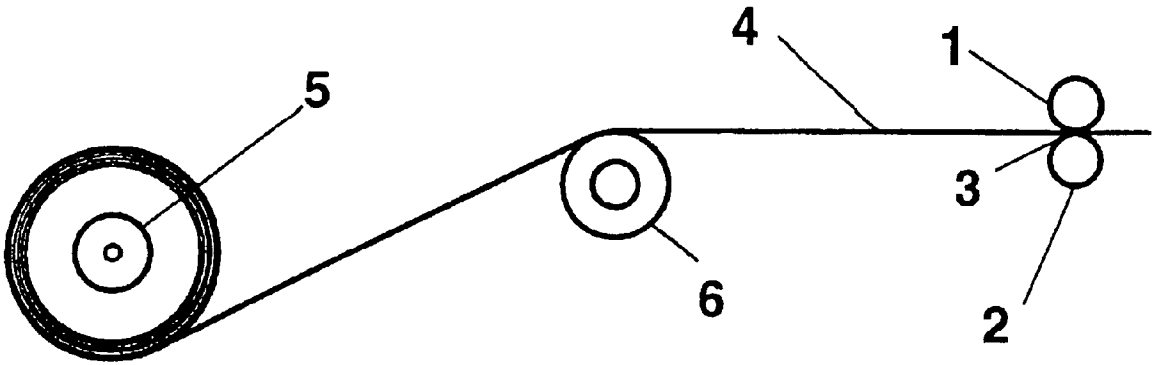
Fig. 1 PRIOR ART
FIG. 1 shows a diagrammatic illustration of a known device for the rolling of strip in a side view.

Two rolls 1 and 2 form between them a roll nip 3, through which a strip 4 is guided, rolled and at the same time reduced in thickness. A winder 5, onto which the strip 4 is wound, is arranged at some distance from the rolls 1, 2. A measuring roller 6 supports the strip 4 from below. Sensors, not illustrated, in the measuring roller measure the forces which occur there and which give a measure of the stresses prevailing in the strip 4.

Figure 2:
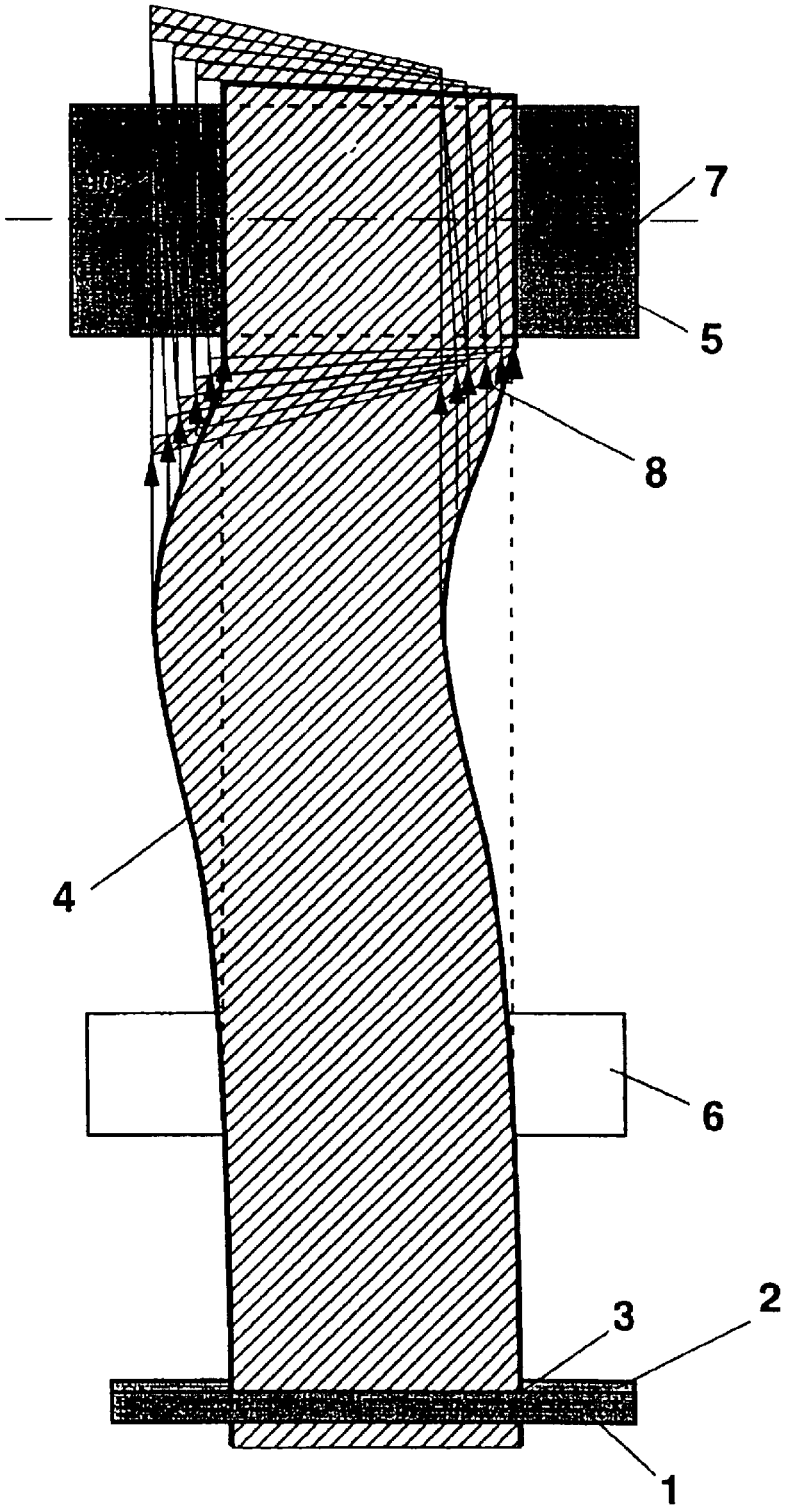
Fig. 2 PRIOR ART
FIG. 2 shows a top view of the device according to FIG. 1 on a larger scale.

Since the strip 4 has a wedge-shaped cross section, it is wound on the winder with varying tautness over its width, so that a higher strip tension is established at the thicker point of the strip. This leads to the strip 4 being deflected laterally between the winder 5 and measuring roller 6. This is reproduced, somewhat exaggerated, in FIG. 2 for the purpose of illustrating the consequences of deflection more clearly. The asymmetric strip tension leads to the strip being bent and no longer meeting the winder 5 perpendicularly with its side edges, that is to say no longer at an angle of 90° to the axis of rotation 7 of the winder 5. As a result, when the strip 4 of wedge-shaped cross section is being wound, the run-on points of the strip on the winder 5 are displaced, and an asymmetric strip geometry is obtained. In FIG. 2, the run-on points of the strip 4 are identified by arrows 8. In this situation, in the length, portion of the strip between the measuring roller 6 and winder 5, a completely uneven stress state is established, in which the stresses arising from the changing strip length and the disturbing stresses occurring due to the asymmetric introduction of tension at the winder and to distortions of the strip 4 running out of true are superposed on one another. The measuring roller 6 and its sensors cannot distinguish between the two types of stress. The measurement values thus obtained are consequently useless.

Figure 3:
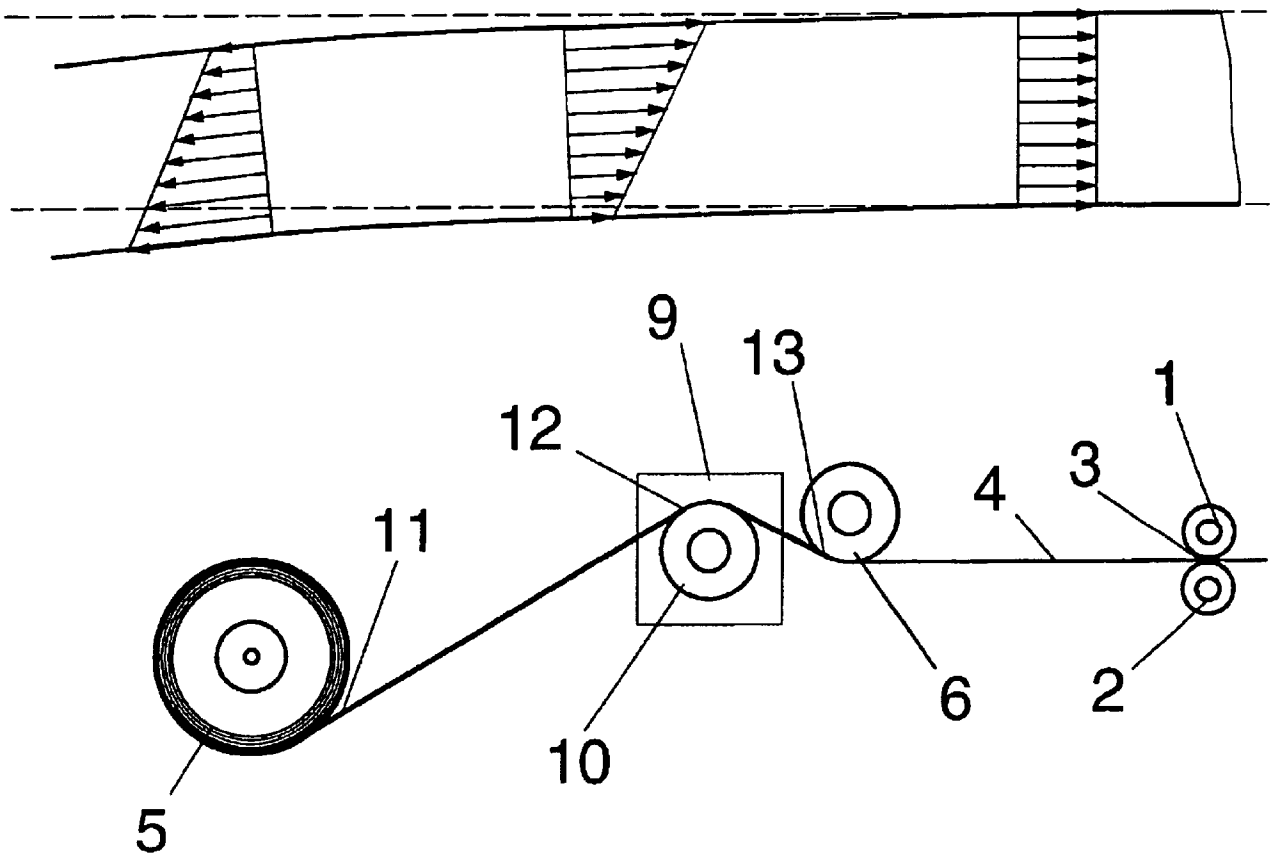
FIG. 3 shows a device according to the invention with single-roller partitioning.

FIG. 3 likewise illustrates a device for the rolling of a strip 4 which is wound by a winder S. In this case, it is unimportant if the measuring roller 6 present there is arranged above the strip 4. It operates on the same principle as the measuring roller 6 in FIGS. 1 and 2. What is critical, however, is that, in FIG. 3, a partitioning device 9 is arranged between the measuring roller 6 and the winder 5. Said partitioning device consists of a roller 10 with a surface having a sufficiently good grip. The roller 10 should also be arranged in such a way that a sufficiently large looping angle is obtained and therefore the strip 4 is in contact with the roller 10 over a large area. The roller 10 could also be adjustable in order to achieve this. During operation, however, its position remains fixed and stable, in order to absorb and dissipate the disturbing stresses which, emanating from the winder 5, take effect in the strip 4 counter to the direction of run of the latter.

Above the device, FIG. 3 also illustrates a top view of the strip 4, in which the forces which occur are illustrated as arrows. On the far left can be seen the unequal forces occurring directly when the strip 4 runs onto the winder 5 at the point identified by 11. The forces taking effect at the point 12 in the strip 4 are illustrated in the middle region. On the far right is illustrated the fact that, in the region: of the measuring roller 6, for example at the point 13, only those forces arise which occur as a result of the length distribution of the strip over the width, because the disturbing stresses emanating from the winder 5 do not pass the partitioning device 9 since they are dissipated.

Figure 4:
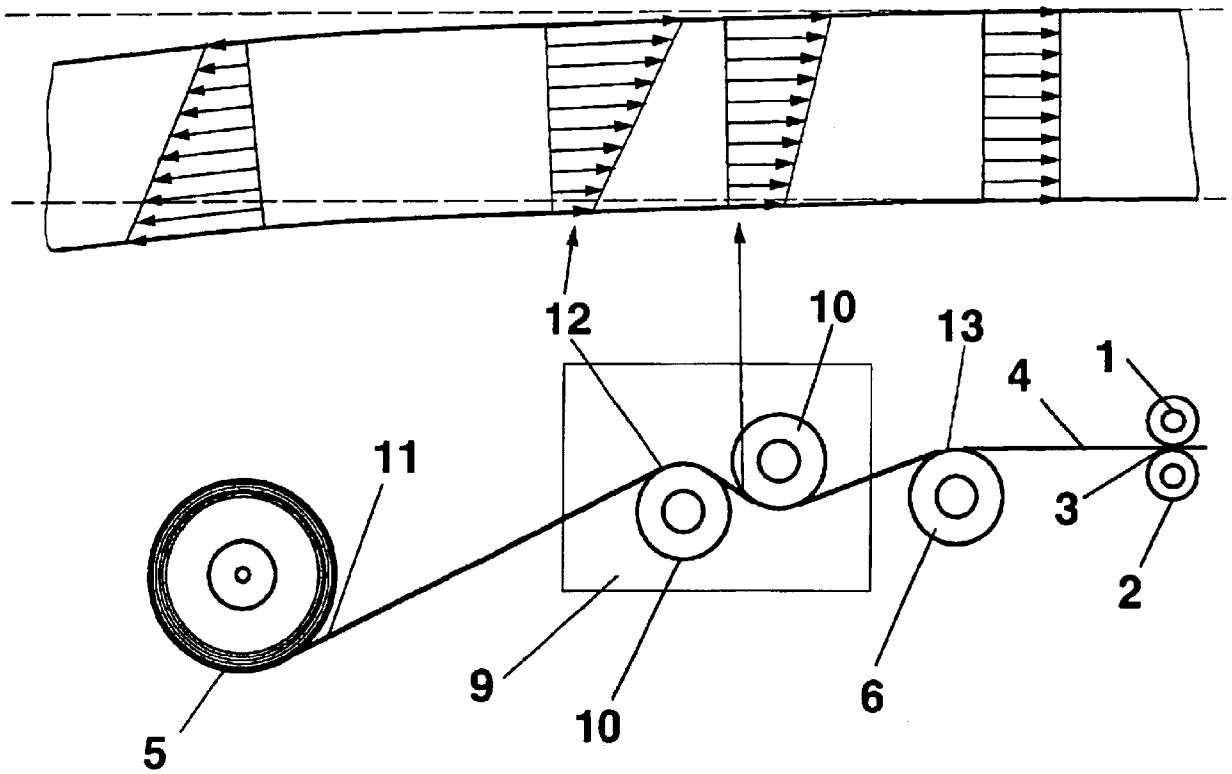
FIG. 4 shows a device according to the invention with double-roller partitioning.

FIG. 4 differs from FIG. 3 primarily in that it illustrates a partitioning device 9 which possesses two rollers 10. In this way, an even larger looping angle as a whole, and therefore even more reliable partitioning of the disturbing stresses, can be achieved. Partitioning devices with more than two rollers 10 are perfectly possible and, in many cases, are even expedient and necessary.

What is claimed is:

1. A method for rolling or winding a strip of wedge-shaped cross section having one edge region that is thicker than another edge region, comprising the steps of:

contacting the strip with a partitioning device so as to absorb transverse stresses in the strip proximate a measuring roller due to asymmetric introduction of tension and distortions in the strip;

measuring a tension in a portion of the strip between rolls, winders, or control, guide or deflecting rollers with said measuring roller, wherein said measurement is made while the partitioning device contacts the portion of the strip; and deriving, from the measured tension, values for controlling and regulating the strip planeness.

2. The method according to claim 1, wherein the partitioning device comprises at least one roller, that is adjustable, but is held fixed during operation.

3. A device for rolling or winding a strip of wedge-shaped cross section having one edge region that is thicker than another edge region, comprising:

a measuring roller for measuring a tension in a portion of the strip between rolls, winders, or control, guide or deflecting rollers, while a partitioning device contacts a portion of the strip;

wherein said partitioning device is adapted to absorb transverse stresses in the strip proximate the measuring roller due to asymmetric introduction of tension and distortions in the strip; and said measuring roller derives values for controlling and regulating strip planeness based upon the measured tension.

4. The device of claim 3 wherein the partitioning device comprises at least one roller, that is adjustable, but is held fixed during operation.

* * * * *